US007305721B2

(12) United States Patent
Matsui et al.

(10) Patent No.: US 7,305,721 B2
(45) Date of Patent: Dec. 11, 2007

(54) TOILET BOWL DEVICE

(75) Inventors: Minoru Matsui, Fukuoka (JP); Tomokazu Goda, Fukuoka (JP); Motoshi Mase, Fukuoka (JP); Katsuhiro Egami, Fukuoka (JP)

(73) Assignee: Toto Ltd., Kitakyushu-shi (JP)

( * ) Notice: Subject to any disclaimer, the term of this patent is extended or adjusted under 35 U.S.C. 154(b) by 79 days.

(21) Appl. No.: 10/528,695

(22) PCT Filed: Sep. 25, 2003

(86) PCT No.: PCT/JP03/12211

§ 371 (c)(1),
(2), (4) Date: Mar. 22, 2005

(87) PCT Pub. No.: WO2004/029374

PCT Pub. Date: Apr. 8, 2004

(65) Prior Publication Data

US 2006/0010592 A1 Jan. 19, 2006

(30) Foreign Application Priority Data

Sep. 25, 2002 (JP) ..... 2002-279796
Jul. 16, 2003 (JP) ..... 2003-275404

(51) Int. Cl.
*E03D 11/02* (2006.01)

(52) U.S. Cl. ..... 4/425; 4/421

(58) Field of Classification Search ..... 4/425, 4/420, 421, 324, 325, 326, 327
See application file for complete search history.

(56) References Cited

U.S. PATENT DOCUMENTS 5,204,999 A * 4/1993 Makita et al. ..... 4/300
5,502,845 A * 4/1996 Hayashi et al. ..... 4/300
6,115,853 A * 9/2000 Shibata et al. ..... 4/425
6,543,066 B2 * 4/2003 Tomita et al. ..... 4/249
7,047,574 B2 * 5/2006 Patterson ..... 4/324

FOREIGN PATENT DOCUMENTS

JP 3-90746 4/1991
JP 11-350578 12/1999
JP 2002-173966 6/2002

OTHER PUBLICATIONS

Office Action from the Korean Patent Office dated Aug. 11, 2006 in the corresponding Korean patent application.

* cited by examiner

*Primary Examiner*—Gregory L. Huson
*Assistant Examiner*—Kristie A. Mahone
(74) *Attorney, Agent, or Firm*—Westerman, Hattori, Daniels & Adrian, LLP.

(57) ABSTRACT

An object of the present invention is to enable provision of a toilet device in which a user can select a necessary toilet wash mode whenever necessary. According to the present invention, in a toilet device which comprises: water supply means for supplying water to a rim water supply portion for flushing wash water to a bowl face of a toilet and to a jet water supply portion for orienting a trap drainage portion of the toilet; and control means for controlling operation of the water supply means, wherein said control means has a toilet wash mode for discharging a stool, and two or more toilet wash modes besides the above mode, and wherein the toilet device is provided with an operation switch for enabling selection of the two or more toilet wash modes.

6 Claims, 16 Drawing Sheets

(A)

(B)

(C)

(D)

TOILET BOWL DEVICE

TECHNICAL FIELD

The present invention relates to a toilet device which has a rim water supply portion and a jet water supply portion independently, and in particular relates to the controls that are preferred for auxiliary supply of water from each water supply portion so that it is easy to clean the inside of the toilet when cleaning the toilet in addition to a cleaning work after use.

BACKGROUND ART

In a conventional toilet device, when cleaning a toilet using a cleaning brush or the like, the wash water trapped in the flushing tank was used in order to rinse a cleaning substance used for cleaning stains clinging in the toilet.

However, the water trapped in the tank is flushed out completely within approximately two to three seconds, and it was necessary to wait for water to be trapped [again] in the tank (approximately thirty seconds to a minute) in order to flush the toilet again. Also, since there is always trapped water remained in a bowl portion, it was difficult to scrub the bottom part of the bowl portion with a cleaning brush or the like to clean [the toilet].

Moreover, in a toilet device which is provided with a jet water supply portion, besides a rim water supply portion, at a bowl portion of the toilet, [the toilet device] is designed such that water is supplied to the jet water supply portion, following the rim water supply portion, thus the problem was that this water would not contribute to rinsing (see Japanese Unexamined Patent Application Publication. H3-90746, for example).

DISCLOSURE OF THE INVENTION

A first object of the present invention is to provide a flush toilet device capable of stopping wash water supplied to a toilet and of flushing whenever necessary.

The toilet device according to a first aspect of the present invention comprises: water supply means for supplying water to a rim water supply portion which flushes wash water onto a bowl face of a toilet and to a jet water supply portion which orients a trap drainage portion; and control means for controlling operation of the water supply means, wherein the toilet device is provided with a switch for cleaning, and, when the switch for cleaning is operated, water is supplied to the jet water supply portion to discharge the water on the surface of the trapped water in the toilet.

In a preferred embodiment related to the first aspect of the present invention, [the toilet device] is constituted such that the control means is used so that the water is supplied by the water supply means into the trap drainage portion, until a predetermined period of time elapses.

Further, in another embodiment besides the above embodiment, [the toilet device] is constituted such that the control means supplies water to the rim water supply portion for a predetermined period of time, prior to supplying water to the jet water supply portion.

Further, in another embodiment besides the above embodiments, [the toilet device] is constituted such that the control means supplies water to the rim water supply portion for a predetermined period of time after supplying water to the jet water supply portion for a predetermined period of time.

Further, in another embodiment besides the above embodiments, after a lapse of time when the abovementioned water supply is stopped, the control means first supplies water to the rim water supply portion for a certain period of time, then performs jet wash, and finally supplies the water to the rim water supply portion again.

Further, when the switch for cleaning is operated before a predetermined period of time elapses, the control means deems that the predetermined period of time has elapsed, and proceeds to a next operation.

BEST MODE FOR CARRYING OUT THE INVENTION

Next, embodiments in which the present invention is substantiated will now be described with reference to the drawings so as to have an understanding of the present invention.

Figure 1:
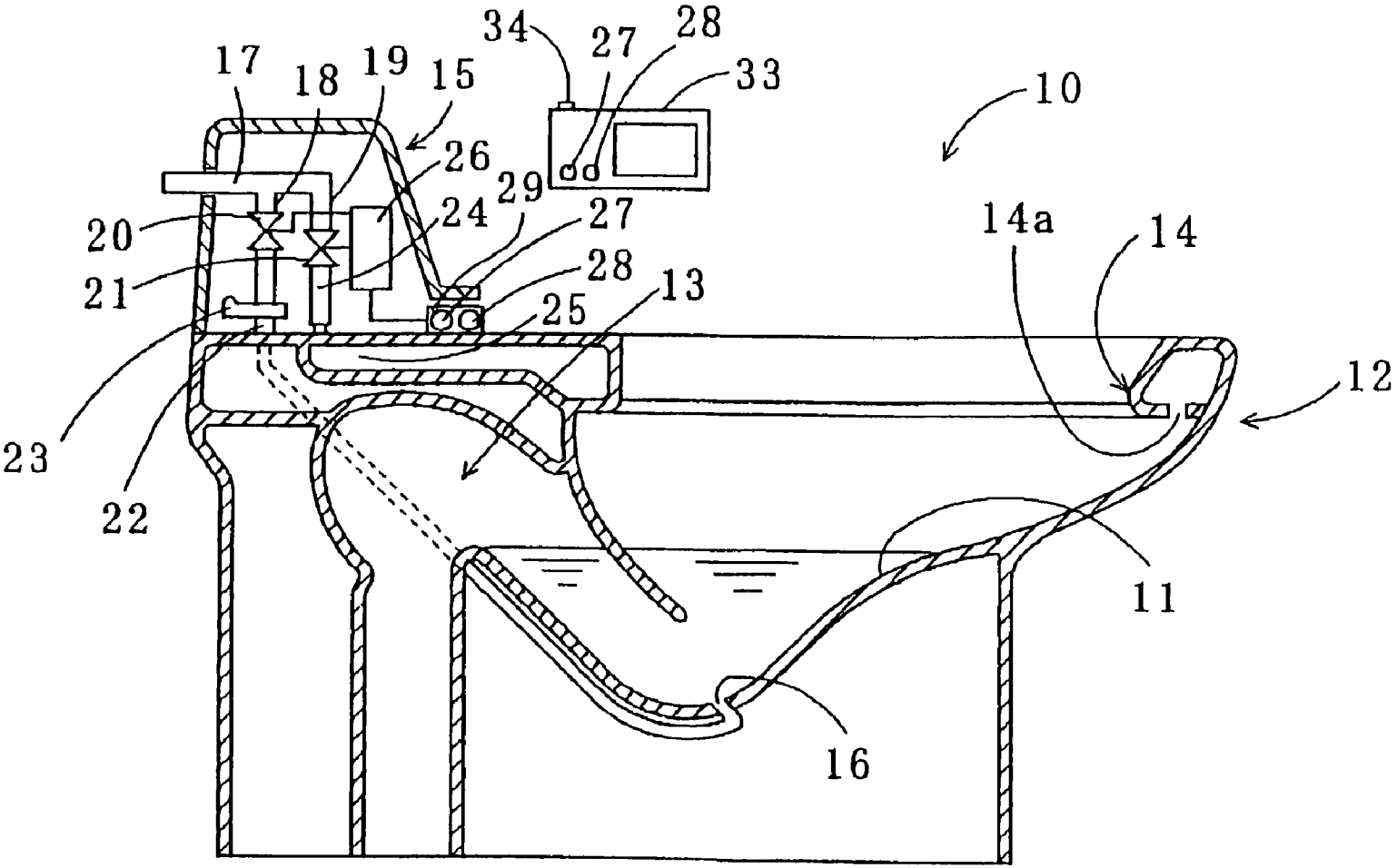
FIG. 1 is an explanatory drawing of a toilet device related to a first embodiment of the present invention.
Figure 2:
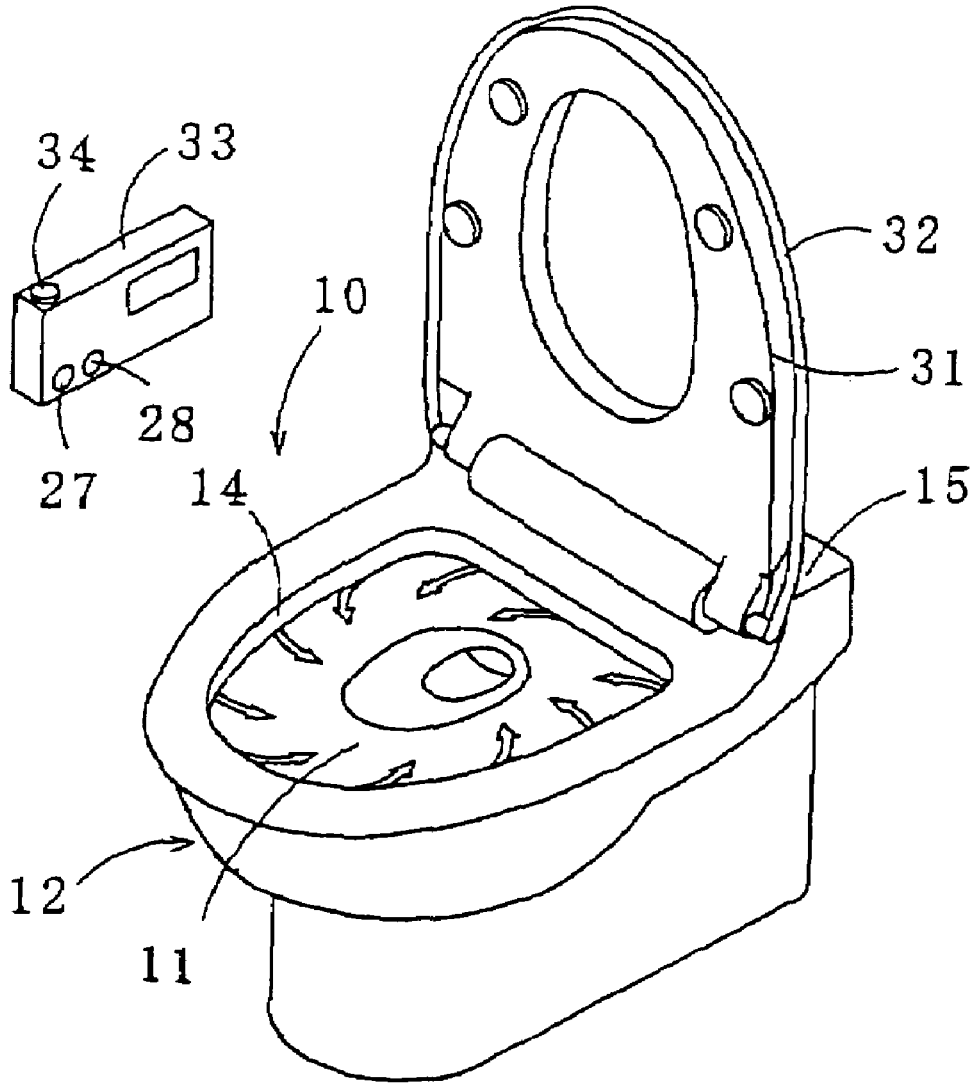
FIG. 2 is a perspective view of the toilet device described in FIG. 1.
Figure 3:
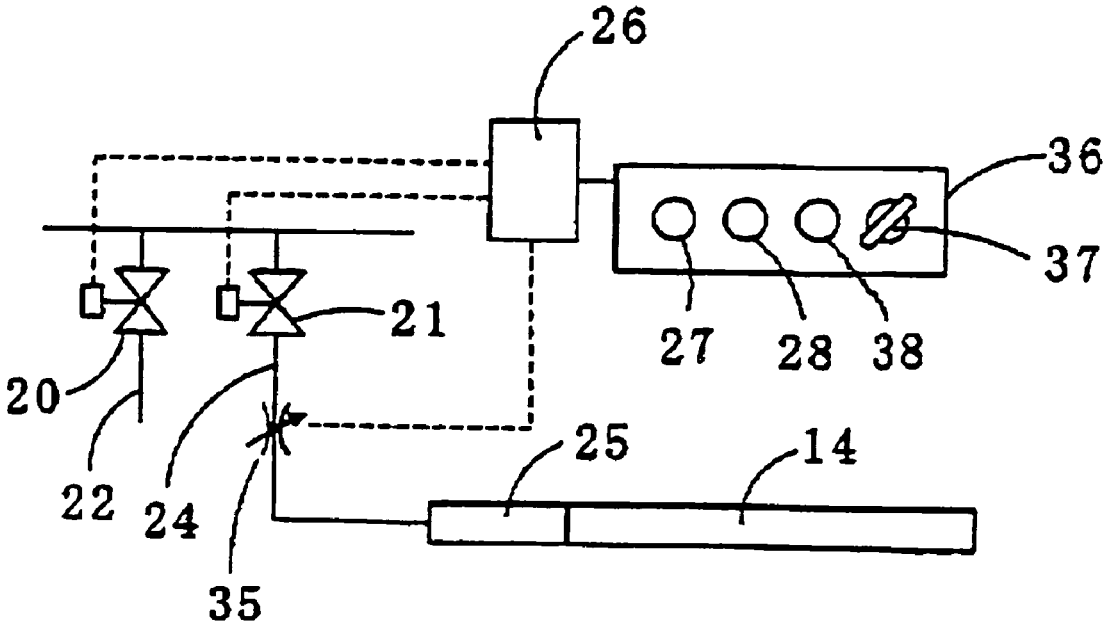
FIG. 3 is a schematic explanatory drawing of the toilet device related to a second embodiment of the present invention.

Here, FIG. 1 is an explanatory drawing of a toilet device related to a first embodiment of the present invention, FIG. 2 is a perspective view of the toilet device described in FIG. 1, and FIG. 3 is a schematic explanatory drawing of the toilet device related to a second embodiment of the present invention.

As shown in FIG. 1 and FIG. 2, a toilet device 10 related to a first embodiment of the present invention is a siphon jet type toilet, and has a porcelain or plastic toilet 12 whose central portion to lower portion forms a bowl portion 11, a trap drainage portion 13, one end of which continues into a bottom portion of the bowl portion 11, a ring-shaped rim water supply portion 14 disposed on an upper end periphery of the toilet 12, and an equipment storage portion 15 provided at an upper rear part of the toilet 12.

A bottom wall of the rim water supply portion 14 has numbers of through holes 14*a* that are formed apart from each other in a circumferential direction, and wash water is released from these holes along the bowl face of the bowl portion 11. The bottom portion of the bowl portion 11 is provided with a spout mouth 16 for the jet wash water orienting one side of the trap drainage portion 13, and the other side of the trap drainage portion 13 is connected to a water supply pipe, which is not shown.

A water supply pipe 17 which is connected to the unshown water pipe is placed inside the equipment storage portion 15, and branch pipes 18 and 19 branch off from the water supply pipe 17. A first water stop valve 20 composed of an electro solenoid valve, which is an example of the water supply means, is connected to the branch pipe 18, and a second water stop valve 21 of an electro solenoid valve, which is also an example of the water-supply means, is connected to the branch pipe 19. A piping 22 which is connected downstream of the water stop valve 20 has an air-released valve 23 in the middle thereon, and the piping 22 is connected to the spout mouth 16. Further, a conducting portion 25 which is connected to the rim water supply portion 14 is connected to a piping 24 positioned downstream of the water stop valve 21.

Note that the rim water supply portion 14 is not limited to the present embodiment in which the conducting portion is provided around the rim on an upper end of the bowl portion 11 of the toilet 12, as will be described in a third embodiment, and may have a composition in which the spout mouth for spurting wash water is provided in the vicinity of the rim at the back of the upper end of the bowl portion 11 such that the wash water coming from the spout mouth is spouted so as to run in spirals in the bowl portion 11.

On the other hand, control means 26 for performing control of the entirety of the flush toilet device 10, including [control of] switching the water stop valves 20 and 21 on and off, is provide inside the equipment storage portion 15. A side of the toilet 12 or of the equipment storage portion 15 is provided with a switch operation portion 29 as an example of the operation means, which is connected to the control means 26 and is equipped with an on-switch 27 and off-switch 28 for switching the water stop valve 21 on and off.

If there is provided side switch box means on a side of the toilet 12, the switch operation portion 29 can be incorporated therein.

In FIG. 2, a numeric "31" is a seat which can be opened and closed, and a numeric "32" is a lid as a cover to be placed [on the seat].

In normal wash, a toilet pot is flushed with the water supplied from the rim water supply portion 14 after use, and then stains are conveyed by the jet wash water supplied from the spout mouth 16, so as to perform flushing with the water supplied again from the rim water supply portion 14 to seal the water.

Because of this structure, the water stop valve 20 is opened if the on-switch 27 of the switch operation portion 29 is pressed, whereby tap water passes through the water stop valve 20 and is supplied to the spout mouth 16 for the jet wash water, time enough to convey the waste ends, and the water stop valve 20 is stopped if a siphon effect occurs at the trap drainage portion 13. Consequently, the water in the bowl portion 11 is drained from a drain pipe, which is not shown, to keep the bowl portion 11 empty of water.

Further, the toilet pot is flushed with the water supplied from the rim water supply portion 14 if the off-switch 28 is pressed, whereby the waste is conveyed by the jet wash water supplied from the spout mouth 16, so as to perform flushing with the water supplied again from the rim water supply portion 14 to seal the water.

In this case, as shown in FIG. 2, by disposing each of the through holes 14*a* at a tilt in a counterclockwise direction, water flow in a counterclockwise direction is formed inside the first and second embodiment bowl portion 11 when flushing the rim, thus the rim is washed so as to cover the entire surface of the first and second embodiment bowl portion 11.

Moreover, in this case, if forgetting to press the off-switch 28, the water in the toilet 12 is not sealed, thus water is automatically supplied to the spout mouth 16 for the jet wash water after an elapse of a predetermined period of time (for example, 1 to 3 minutes), and water is supplied to the trap drainage portion 13.

Next, the toilet device related to a second embodiment is now described with reference to FIG. 3, in which different numeric are used on the parts that are different from those in the flush toilet device 10 of the first embodiment (same for the following embodiment).

In the toilet device related to the second embodiment, the piping 24 on the downstream side of the water stop valve 21 is provided with a flow regulating valve 35. On the flow rate regulating valve 35, the flow rate can be regulated by an electric signal, and the opening of the valve after normal use of the toilet is the maximum. On the other hand, when performing an "OFF"-operation through a switch operation portion 36, which is an example of the operation means, a control knob (volume) 37, which is an example of a flow rate regulating portion, is provided separately such that the first rim flush flow rate can be adjusted for a constant period of time in a single step, or can be adjusted in stages. Thereby, when carrying out the first rim flush after the off-switch 28 is pressed, the flow rate at the moment when the water is supplied can be adjusted. Therefore, it is possible to minimize the amount of the water in the case where the toilet 12 is cleaned using a brush, or in other occasions.

Further, when a rim flush off switch 38 of the switch operation portion 36 is pressed during the first rim flush, the water supplied to the rim water supply portion 14 is stopped, supply of water to the rim water supply portion 14 is stopped, and the siphon effect occurs at the trap drainage portion 13 due to the jet wash water supplied from the spout mouth 16, to discharge the trapped water, whereby flushing is carried out again with the water supplied from the rim water supply portion 14 to seal the water. Accordingly, it is possible to adjust the time taken for the first rim flush.

In the above-described embodiments, although the operation means (the switch operation portions 29, 36) is disposed on a side of the toilet 12, it can be provided inside a remote control box 33 (see FIG. 1 and FIG. 2), which is an example of remote control switching means disposed separately.

The remote control box 33 having a battery as a drive power in these embodiments is equipped with a projector 34 consisting of a light-emitting diode and disposed facing the ceiling of the bathroom, and is designed such that an unshown optical receiver consisting of a phototransistor, photodiode or the like and provided in a specific position in the equipment storage portion 15 is illuminated, and that a signal is transmitted to the control means 26 to open and close the water stop valves 20, 21.

Next, the composition of a valve that can be applied to the toilet device related to each of the above-described embodiments will now be described in detail with reference to the drawings.

Figure 4:
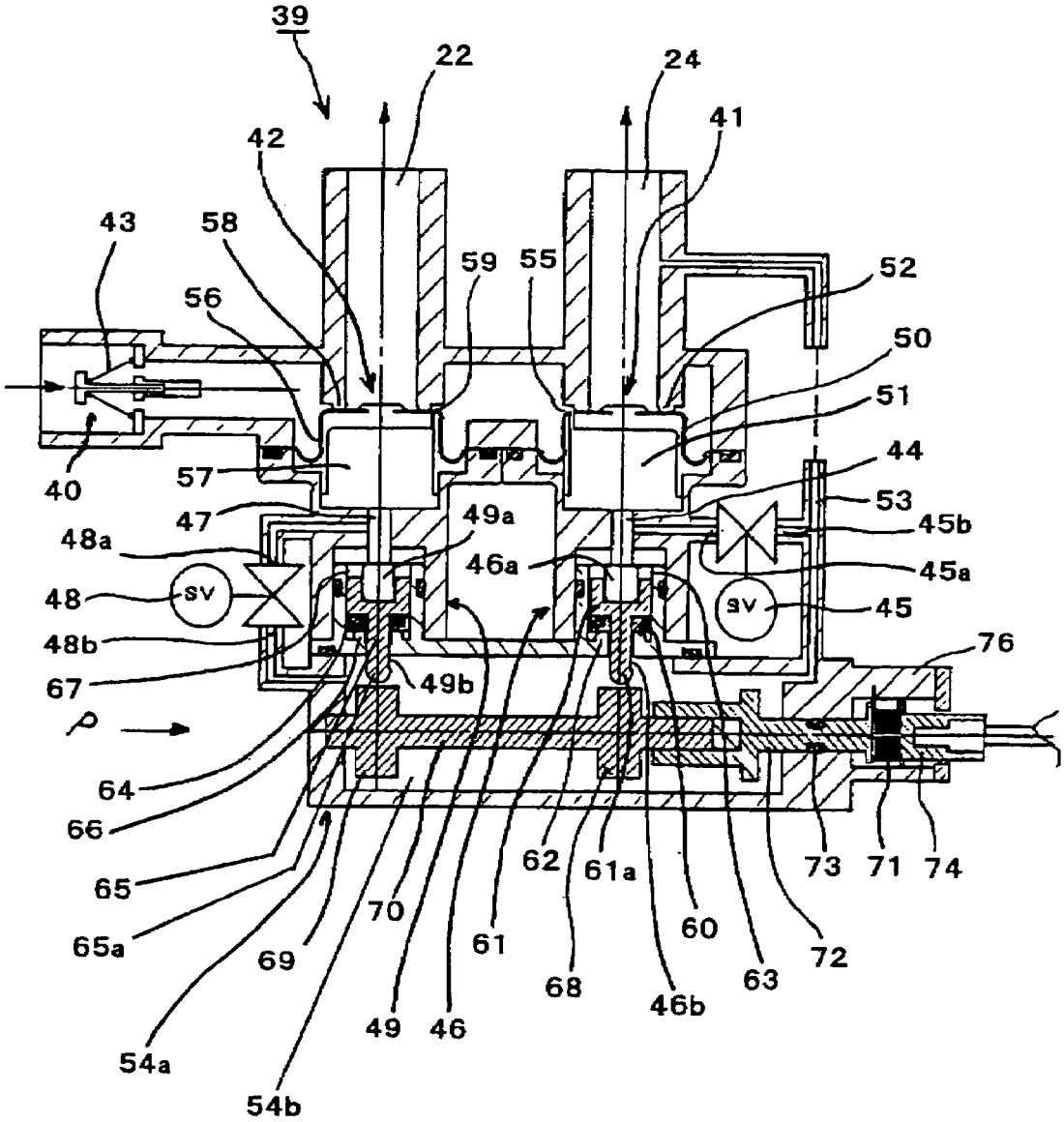
FIG. 4 is a schematic cross-sectional view showing an example of a valve portion which is applied to the toilet device related to each embodiment.

FIG. 4 is a schematic cross-sectional view showing an example of a valve portion which can be applied to the toilet device related to each of the above-described embodiments.

In FIG. 4, a valve portion 39 is equipped with a constant flow rate valve 40 which is coupled with an introducing path for leading tap water, and which is for adjusting opening thereof in accordance with a variation of the water supply pressure to keep the flush flow rate substantially constant, a first open/close valve 41 which branches off of the constant flow rate valve 40 at its secondary side and which is for supplying water to a bowl water supply path (i.e. piping) 24, and a second open/close valve 42 for supplying water to a trap water supply path (i.e. piping) 22. The first open/close valve 41 and the second open/close valve 42 are opened and closed by opening and closing a pilot flow path by means of a pilot-operated valve. The constant flow rate valve 40 is formed with a substantially cone-shaped coil spring 43 where the area between the spaces thereof is changed by a pressure difference between the front and back [of the spring]. When the pressure difference is big, the displacement of the coil spring 43 becomes larger and the area between the spaces decreases. When the pressure difference is small, the displacement of the coil spring 43 becomes small and the area between the spaces increases. The spring constant of the coil spring 43 is set such that the area between the spaces is inversely proportional to the square root of the pressure difference because [the water] passes through the space at a flow speed that is proportional to the square root of the pressure difference. The flow rate the wash water that flows the introducing path is kept substantially constant by the constant flow rate valve 40 even when the water supply pressure is changed.

A first pilot flow path 44 for controlling opening and closing of the first open/close valve 41 is constituted in a flow path in which a first solenoid valve 45 is connected in parallel with a first manual operation valve 46. Similarly, a second pilot flow path 47 for controlling opening and closing of the second open/close valve 42 is constituted in a flow path in which a second solenoid valve 48 is connected in parallel with a second manual operation valve 49.

When electrically driving the first open/close valve 41 and the second open/close valve 42, the first solenoid valve 45 and the second solenoid valve 48 are opened and closed respectively. When manually performing opening and closing, the first manual operation valve 46 and the second manual operation valve 49 are opened and closed by manual valve opening/closing means (as will be described hereinbelow).

The first open/close valve 41 is constituted by a diaphragm 50, first pressure chamber 51 as a part of a partition wall of the diaphragm 50, and first valve seat 52 which is attached firmly by pressure of the first pressure chamber 51 to the diaphragm 50 and which blocks the bowl water supply path (i.e. piping) 24. The first pressure chamber 51 is communicated with the first pilot flow path 44, and the first pilot flow path 44 is communicated with end portions 45*a* and 46*a* on the flow paths of the first solenoid valve 45 and the first manual operation valve 46. The other end portion 45*b* on the flow path of the first solenoid valve 45, and the other end portion 46*b* at the flow path of the first manual operation valve 46 are merged at a merging path 53 and are communicated with the bowl water supply path (i.e. piping) 24. The other end portion 46*b* on the flow path of the first manual operation valve 46 is communicated with a storage space portion 54*b* which stores a camshaft, which will be described later, and is communicated with the merging path 53 by using the storage space portion 54*b* as a flow path. Moreover, the diaphragm 50 is equipped with a bleed hole 55 for effecting a communication between the abovementioned introducing path and the first pressure chamber 51.

The second open/close valve 42 is constituted by a diaphragm 56, second pressure chamber 57 as a part of a partition wall of the diaphragm 56, and second valve seat 58 which is attached firmly by pressure of the second pressure chamber 57 to the diaphragm 56 and which blocks the trap water supply path (i.e. piping) 22. The second pressure chamber 57 is communicated with the second pilot flow path 47, and the second pilot flow path 47 is communicated with end portions 48*a* and 49*a* on the flow paths of the second solenoid valve 48 and second manual operation valve 49. The other end portion 48*b* on the flow path of the second solenoid valve 48 and the other end portion 49*b* on the flow path of the second manual operation valve 49 are communicated [with each other] in the storage space portion 54*b* which stores a camshaft, which will be described later, are then communicated with the merging path 53 and are communicated with the trap water supply path (i.e. piping) 22. Moreover, the diaphragm 56 is equipped with a bleed hole 59 for effecting a communication between the abovementioned introducing path and the second pressure chamber 57.

The first manual operation valve 46 consists of a first head 61 and first pilot valve seat 62 integrated with a rubber packing 60, and a coil spring 63 which energizes the rubber packing 60 in a direction for attaching it firmly to the first pilot valve seat 62. A pressuring portion 61*a* of the first head 61 is protruded to the storage space portion 54*b*.

By pressuring the first head 61 against a force generated by water pressure and against an energizing force of the coil spring 63, the first manual operation valve 46 is opened, and the pressure of the first pressure chamber 51 decreases to a pressure which is substantially the same as that of the bowl water supply path (i.e. piping) 24, whereby the balance of a force applied to the diaphragm 50 is disrupted, and the diaphragm 50 separates from the first valve seat 52, thereby opening the first open/close valve 41. When the pressure applied to the first head 61 is removed, the rubber packing 60 sticks to the first pilot valve seat 62 by the force generated by water pressure and the force of the coil spring 63, whereby the first pilot flow path 44 is closed. When the first pilot flow path 44 is closed, the wash water passes through the bleed hole 55 from the introducing path and flows into the first pressure chamber 51, the pressure of the first pressure chamber 51 becomes substantially the same as the pressure of the introducing path, and the diaphragm 50 is firmly attached to the first valve seat 52 to block the bowl water supply path (i.e. piping) 24.

The second manual operation valve 49 consists of a second head 65 and second pilot valve seat 66 integrated with a rubber packing 64, and a coil spring 67 which energizes the rubber packing 64 in a direction for attaching it firmly to the second pilot valve seat 66. A pressuring portion 65*a* of the second head 65 is protruded to the storage space portion 54*b*.

By pressuring the second head 65 against a force generated by water pressure and against an energizing force of the coil spring 67, the second manual operation valve 49 is opened, and the pressure of the second pressure chamber 57 decreases to a pressure which is substantially the same as that of the bowl water supply path (i.e. piping) 24, whereby the balance of a force applied to the diaphragm 56 is disrupted, and the diaphragm 56 separates from the second valve seat 58, thereby opening the trap water supply path (i.e. piping) 22. When the pressure applied to the second head 65 is removed, the rubber packing 64 is firmly attached to the second pilot valve seat 66 by the force generated by water pressure and the force of the coil spring 67, whereby the second pilot flow path 47 is closed. When the second pilot flow path 47 is closed, the wash water passes through the bleed hole 59 from the introducing path and flows into the second pressure chamber 57, and the pressure of the second pressure chamber 57 becomes substantially the same as the pressure of the introducing path, and the diaphragm 56 is firmly attached to the second valve seat 58 to block the trap water supply path (i.e. piping) 24.

A user rotates and operates a handle (not shown), whereby the mechanical operating force thereof is transmitted from the handle (not shown) to the manual valve opening/closing means (not shown) for opening and closing the first manual operation valve 46 and second manual operation valve 49 via operating force transmitting means (not shown), whereby the wash water is supplied independently to the bowl water supply path (i.e. piping) 24 or to the trap water supply path (piping) 22. The wash water is supplied to the bowl water supply path (i.e. piping) 24 when rotating the handle (not shown) 90 degrees in a counterclockwise direction from the initial position, and is supplied to the trap water supply path (i.e. piping) 22 when rotating [the handle] 90 degrees in a clockwise direction from the initial position, thus the wash water can be supplied to the toilet 12 by a manual operation.

The above-described manual valve opening/closing means is constituted by a camshaft 70 equipped with a first cam 68 which pressures the pressuring portion 61*a* of the first head 61 and with a second cam 69 which pressures the pressuring portion 65*a* of the second head 65, by a torsion spring 71 for recovering the camshaft 70 to the initial position, and by a connecting shaft 72 for coupling the abovementioned operation force transmitting means (not shown) with the camshaft 70. Further, by rotating and operating the camshaft 70, the first manual operation valve 46 and the second manual operation valve 49 are opened and closed.

The camshaft 70, first cam 68, second cam 69, and connecting shaft 72 as an operation shaft of the camshaft 70 are disposed with being stored in the storage space portion 54*b* formed in a casing 54*a* of the valve portion 39. The connecting shaft 72 is provided with a protrusion 74 which is sealed by an o-ring 73 and is protruded in the air, the protrusion 74 engages with the abovementioned operation force transmitting means (not shown), and the camshaft 70 is rotated by the abovementioned handle (not shown) coupled with the operation force transmitting means (not shown).

The camshaft 70, first cam 68, and second cam 69 are disposed in a submerged state in the storage space portion 54*b* which is communicated with the merging path 53 for the pilot operated water, thus the abovementioned manual valve opening/closing means can be integrated with the first open/close valve 41 and second open/close valve 42 to minimize the toilet water supply device.

Figure 5:
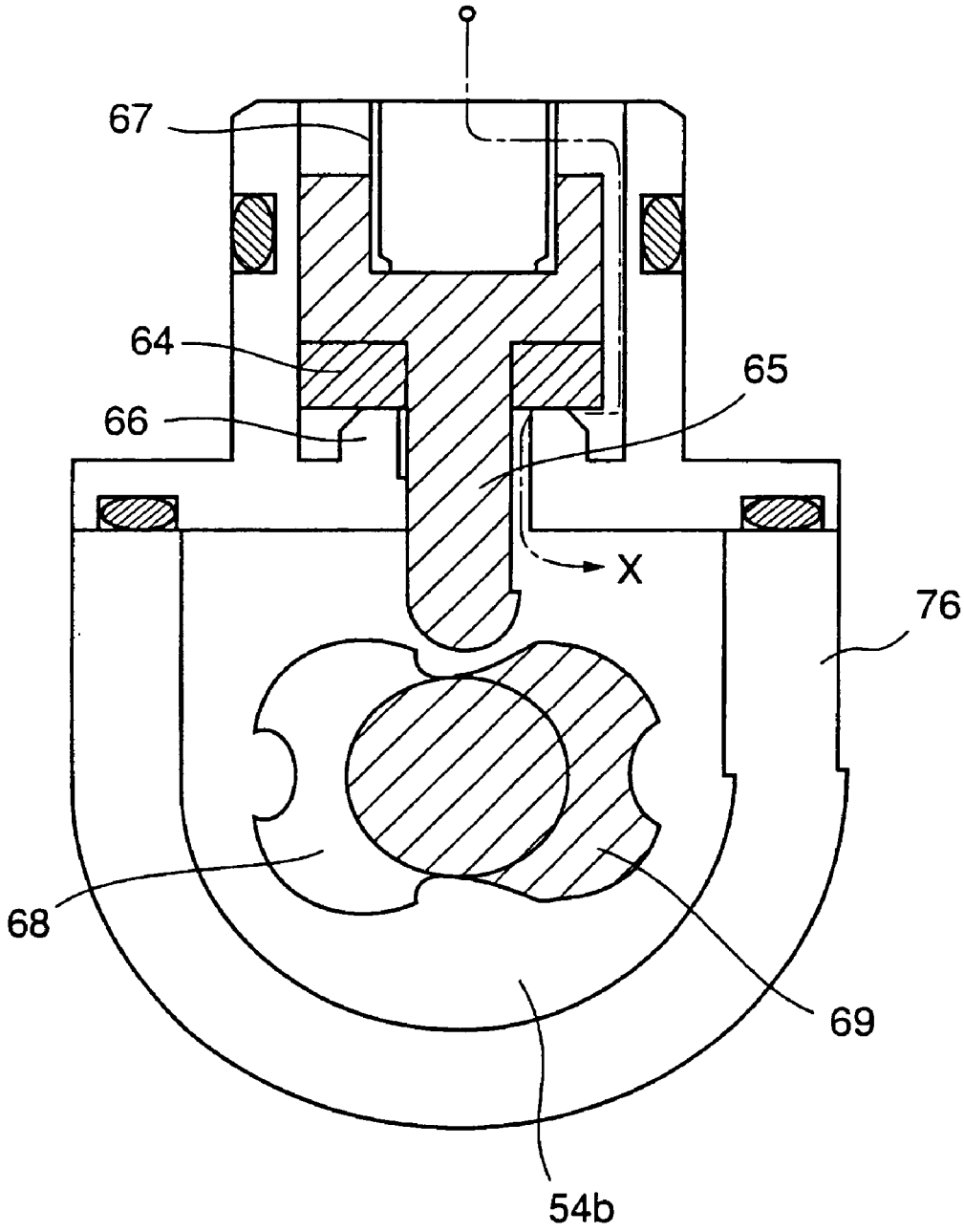
FIG. 5 is a cross-sectional view showing an initial state of a camshaft when viewed from the direction of P of FIG. 4.

FIG. 5 is a cross-sectional view showing an initial state where the camshaft 70 is in, when viewed from the direction of P of FIG. 4.

As described in FIG. 4, the first cam 68 and second cam 69 that respectively pressure the first head 61 and second head 65 are disposed in the camshaft 70. By rotating the camshaft 70 in a counterclockwise direction, the second head 65 is pressured by the second cam 69 and is moved upward in FIG. 5, the rubber packing 64 separates from the second pilot valve seat 66, and the pressure chamber 57 and merging path 53 are communicated with each other via the storage space portion 54*b* as indicated by the arrow X. Consequently, the pressure in the pressure chamber 57 decreases, and the second open/close valve 42 is opened so the wash water is supplied to the trap water supply path (i.e. piping) 22.

Similarly, by rotating the camshaft 70 in a clockwise direction, the first head 61 is pressured by the first cam 68 and moved upward, the rubber packing 60 separates from the first pilot valve seat 62, and the pressure chamber 51 and merging path 53 are communicated with each other. Consequently, the pressure in the pressure chamber 51 decreases, and the first open/close valve 41 is opened so the wash water is supplied to the bowl water supply path (i.e. piping) 24.

Figure 6:
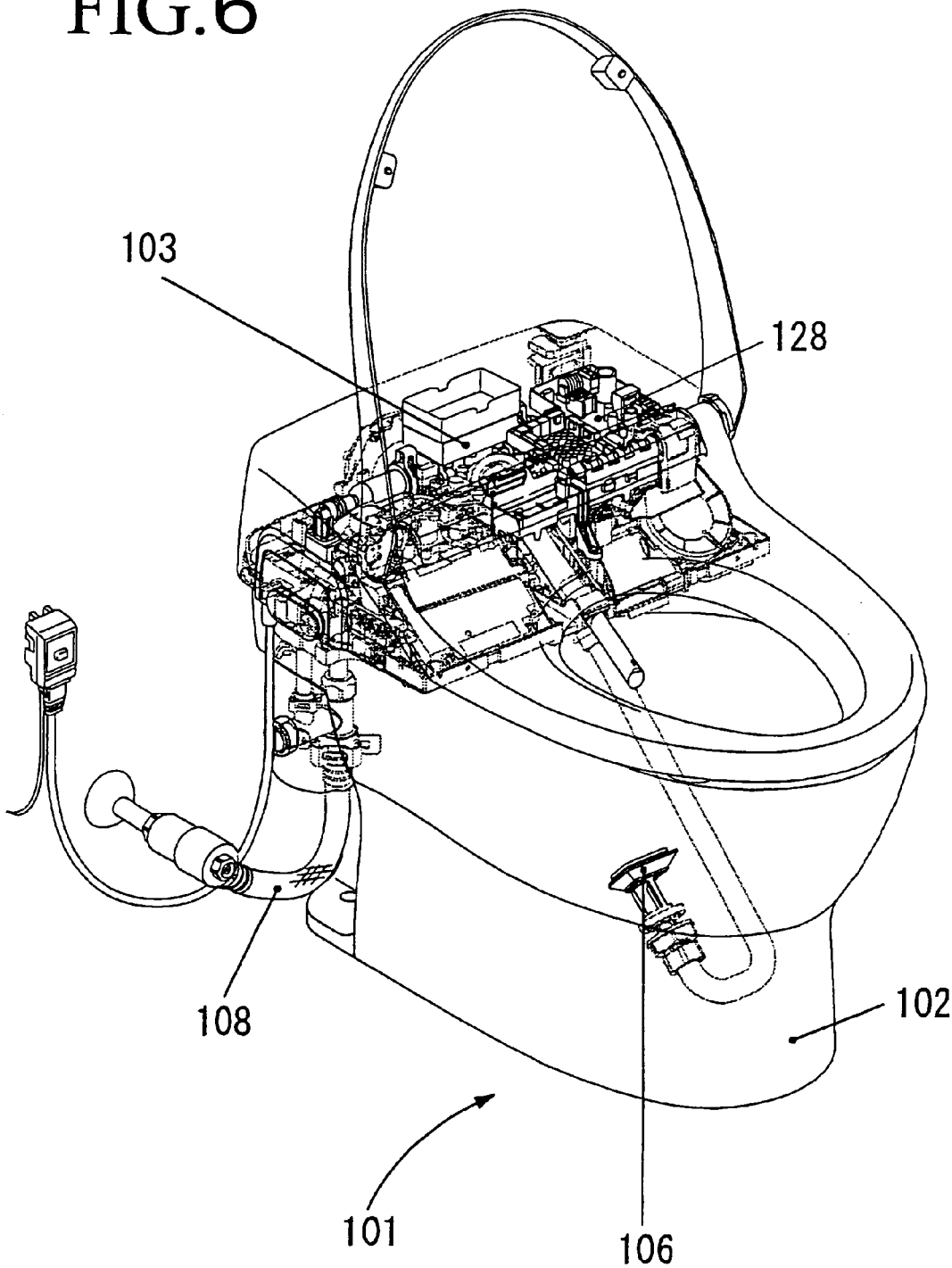
FIG. 6 is a perspective view showing the toilet device related to a third embodiment of the present invention.
Figure 7:
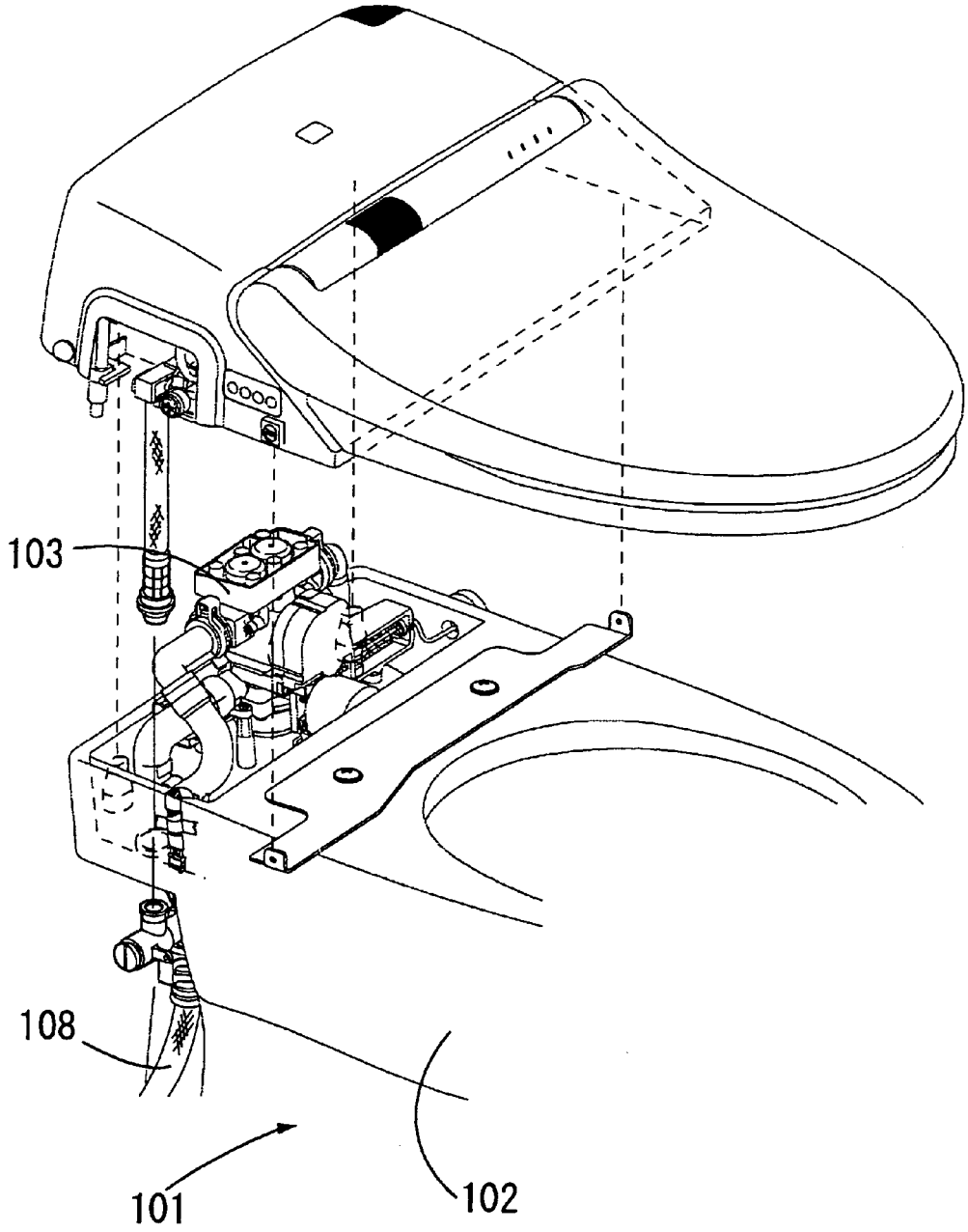
FIG. 7 is an exploded perspective view of the toilet device described in FIG. 6.

FIG. 6 is a perspective view showing, from the front, a toilet device related to a sixth embodiment of the present invention, and FIG. 7 is a perspective view of the toilet device described in FIG. 6, in a state where the toilet and the cover are separated.

As shown in FIG. 6 and FIG. 7, the toilet device 101 related to the present embodiment is constituted by a western style third embodiment toilet 102, a wash water supply device 103 as the water supply means disposed between the third embodiment toilet 102 and a water pipe 108 as a water supply source, a local washing device (explanation omitted) attached on the cover side, and a control device 128 for electrically controlling the wash water supply device 103 and local flushing device.

Figure 8:
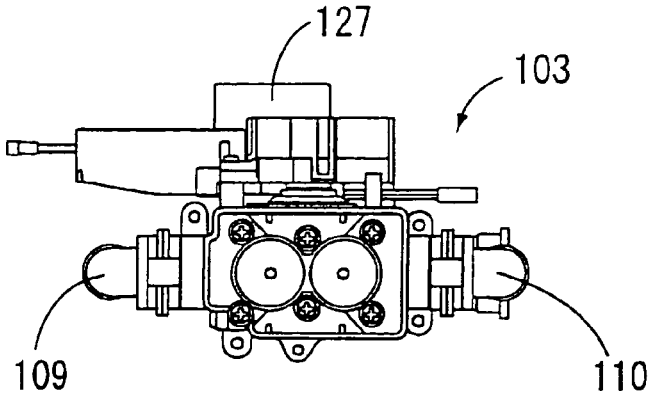
FIG. 8 is an assembly drawing of a wash water supply device related to the third embodiment of the present invention.
Figure 8:
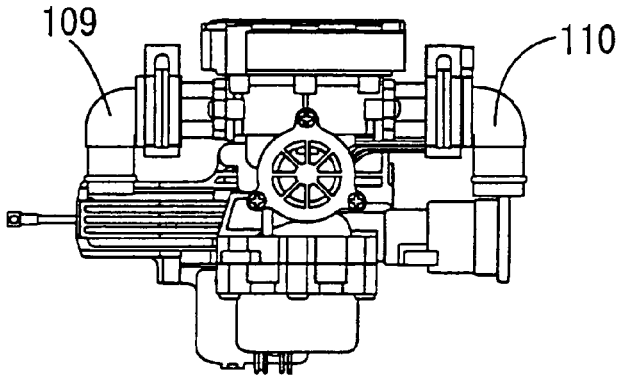
Figure 8:
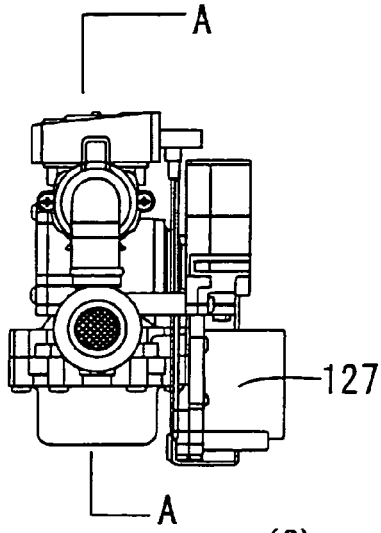
Figure 8:
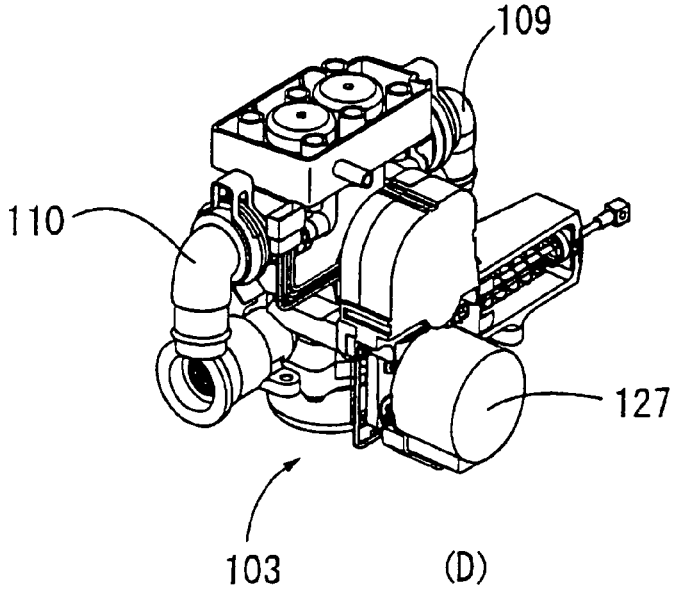
Figure 9:
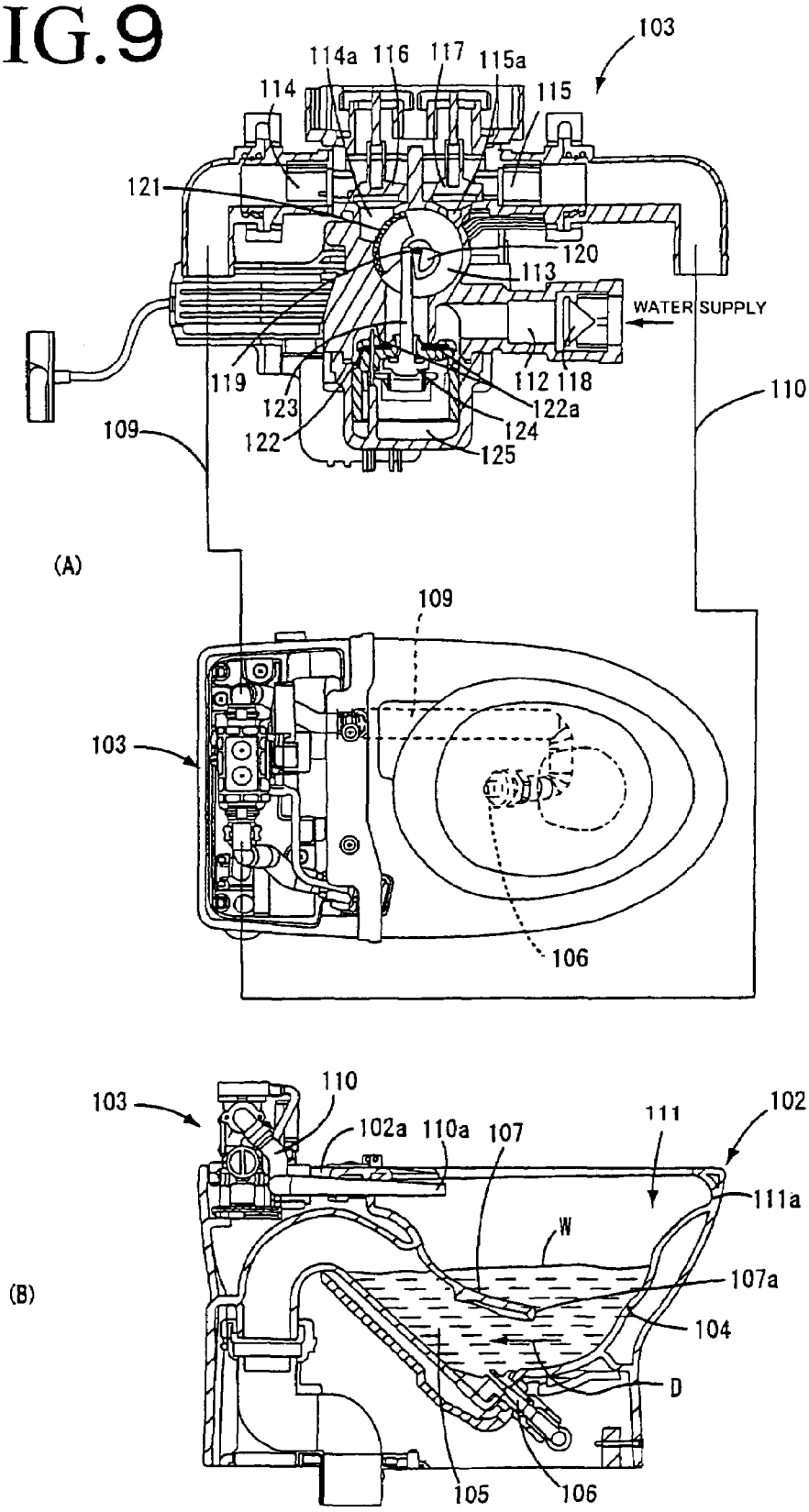
FIG. 9 is a schematic drawing of the toilet device related to the third embodiment of the present invention, the toilet device being in a state where water supply is stopped.

FIG. 8 has an assembly drawing viewed from the three sides of the wash water supply device 103 shown in FIG. 7 and FIG. 2, and a perspective view of same, FIG. 9 is a figure for explaining a state where the wash water supply device 103 is in and a state where the water is supplied to the toilet 102, by combining a cut-away sectional view taken along the line A-A of FIG. 8, and a top view and sectional side view of the toilet 102. Note in FIG. 9 that the wash water supply device 103 is in an initial state where the wash water is not flowing.

As shown in FIG. 9, the toilet 102 is provided with a trap portion 105 for discharging stains inside a bowl portion 104, a jet water supply portion 106 for spewing the wash water to the trap portion 105, and a partition wall 107 for partitioning the trap portion 105 and bowl portion 104. The jet water supply portion 106 is disposed nearer to the discharge direction D than a lower edge portion 107*a* of the partition wall 107. A rim portion 111 is formed on the upper part of the bowl portion 104, the wash water of the bowl portion 104 is supplied along an inner wall face 111*a* which is directly on the inside of the bowl portion 104 of the rim portion 111.

Further, a hollow portion 102*a* of the toilet 102 is equipped with a jet water supply path 109 for supplying the wash water, which is fed from the water pipe 108, to the jet water supply portion 106, and a rim water supply path 110 having, at a tip end thereof, a rim water supply mouth 110*a* which is oriented in a substantially horizontal position in order to supply the wash water to the bowl portion 104 through the inner wall face 111*a* of the rim portion 111.

The wash water supply device 103 is equipped with a conducting pipe 112 for introducing the wash water fed from the water pipe 108, a constant flow rate valve 118 for setting the wash water introduced by the conducting pipe 112 to a predetermined flow rate regardless of the water supply pressure, a wash water distribution chamber 113 for distributing the wash water to the jet water supply path 109 and rim water supply path 110, a jet water supply port 114 and rim water supply port 115 for feeding the wash water distributed at the wash water distribution chamber 113 to the jet water supply path 109 and rim water supply path 110 respectively, negative pressure breaking valves 116 and 117 disposed respectively in the jet water supply port 114 and rim water supply port 115 to introduce the air, and other components.

The wash water distribution chamber 113 is provided with a cam 120 which is turned in a clockwise direction or counterclockwise direction along with a drive shaft 119 by a motor 127 (see FIG. 8), and a fan-shaped switching valve 121 which is rotated by the motor 127 in a clockwise or counterclockwise direction. The lower part of the wash water distribution chamber 113 is provided with a diaphragm main valve 122 which opens and closes the conducting channel led from the conducting pipe 112, a valve shaft 123 disposed perpendicularly at the center of the main valve 122, a pilot valve 124 coupled with the lower part of the valve shaft 123, a pressure chamber 125 in which the pilot valve 124 is stored and which opens and closes the main valve 122 with water pressure applied from the water pipe 108, a bleed hole for effecting a communication between the conducting pipe 112 and pressure chamber 125, and other components. The present figure shows a state in which the main valve 122 abuts on a water stop portion 122*a* because the pilot valve is closed, whereby the water is stopped.

Next, FIG. 10 to FIG. 13 are used to explain an operating state of the wash water supply device 103 in execution of the clean modes where the steps of "rim wash mode 1", "jet wash mode 1", "jet wash mode 2", and "rim wash mode 2" are sequentially executed.

Figure 10:
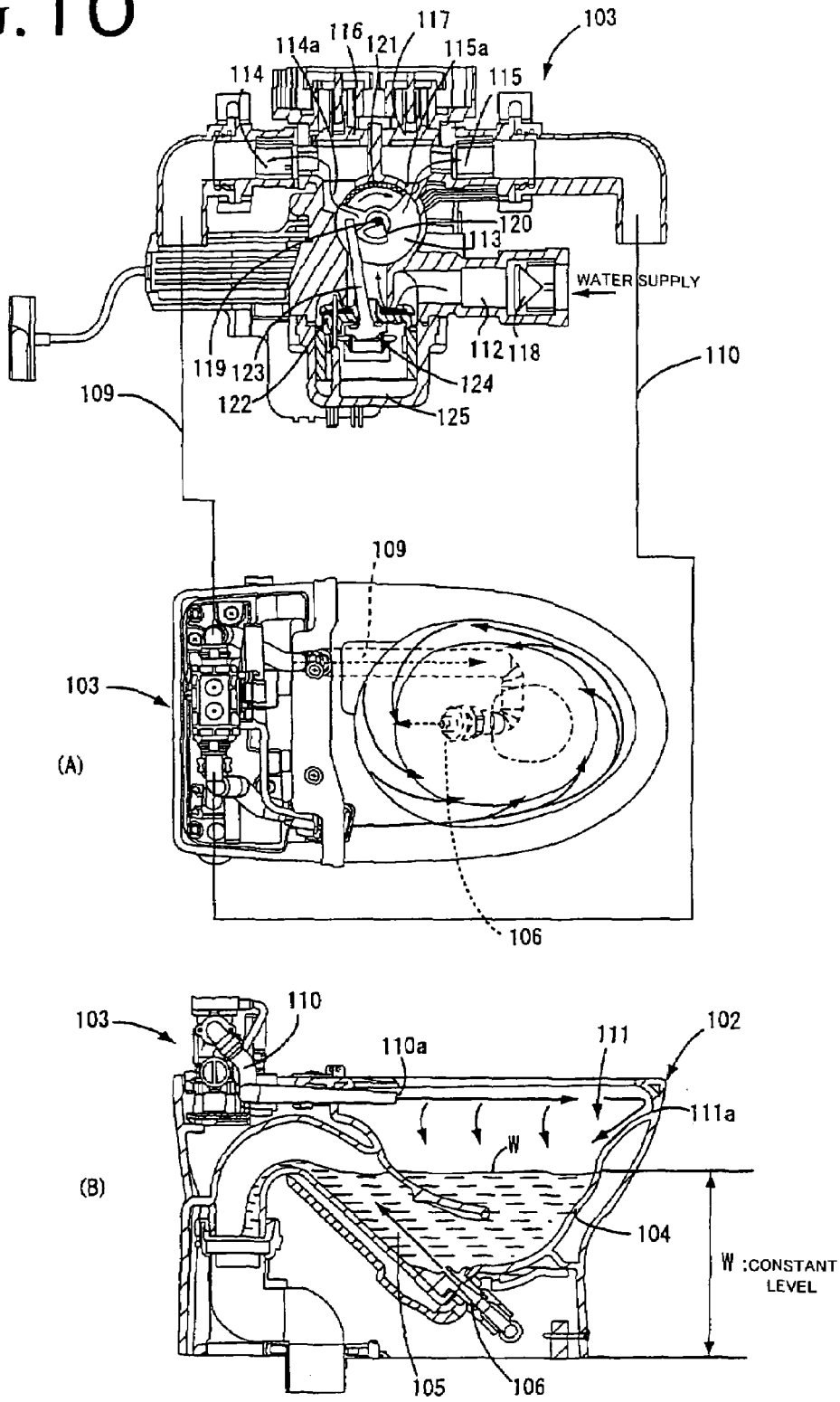
FIG. 10 is a schematic drawing of rim wash mode 1 in the toilet device related to the third embodiment of the present invention.

First of all, FIG. 10 is used to explain "rim wash mode 1". In a state where the water is stopped as in FIG. 9, when a "pour" command is sent from the control portion 128 of the toilet device 101 to the wash water supply device 103, the motor 127 is activated, the drive shaft 119 is rotated, and the cam 120 is rotated along with the drive shaft 119 by a predetermined angle in a clockwise direction on the basis of flow rate distribution, which will be described hereinbelow, the pilot valve 124 is opened by slanting [the valve shaft 123] when the cam 120 abuts against the valve shaft 123, whereby the pressure of the pressure chamber 125 decreases and the main valve 122 opens, thus the wash water is introduced from the conducting pipe 112 into the wash water distribution chamber 113. At this time, the switching valve 121 is opened about ¼ of the way on a pouring mouth 114*a* side thereof, thus a pouring mouth 115*a* is in a half-open position (position shown in the figure).

Therefore, the water is supplied in the proportion of a 7 L/min flow rate to the jet side, and a 13 L/min flow rate to the rim side. The wash water set to a predetermined flow rate (20 L/min) by the constant flow rate valve 118 flows out of the wash water distribution chamber 113 into the pouring mouth 114*a* or 115*a*, pushes up the negative pressure breaking valve 116 or 117 to go through the jet water supply port 114 or rim water supply port 115, and through jet water supply path 109 or rim water supply path 110, and is spouted out of the jet water supply portion 109*a* or rim water supply mouth 110*a* to the third embodiment trap portion 105 or rim portion 111 respectively. The wash water spouted out of the rim water supply mouth 110*a* to the rim portion 111 falls into the third embodiment bow portion 104, circling the rim portion 111 of the third embodiment toilet 102. Rim flushing for flushing the third embodiment bowl portion 104 is performed in this process of circling and falling.

In "rim wash mode 1", the siphon effect does not occur because the amount of the bowl supply water supplied from the rim supply water mouth 110*a* is high, and the amount of the trap supply water supplied from the jet water supply portion 106 is low, thus it is possible to perform the rim washing by holding the water level of the trapped water W inside the bowl portion 104 to a constant level without lowering [the level].

Figure 11:
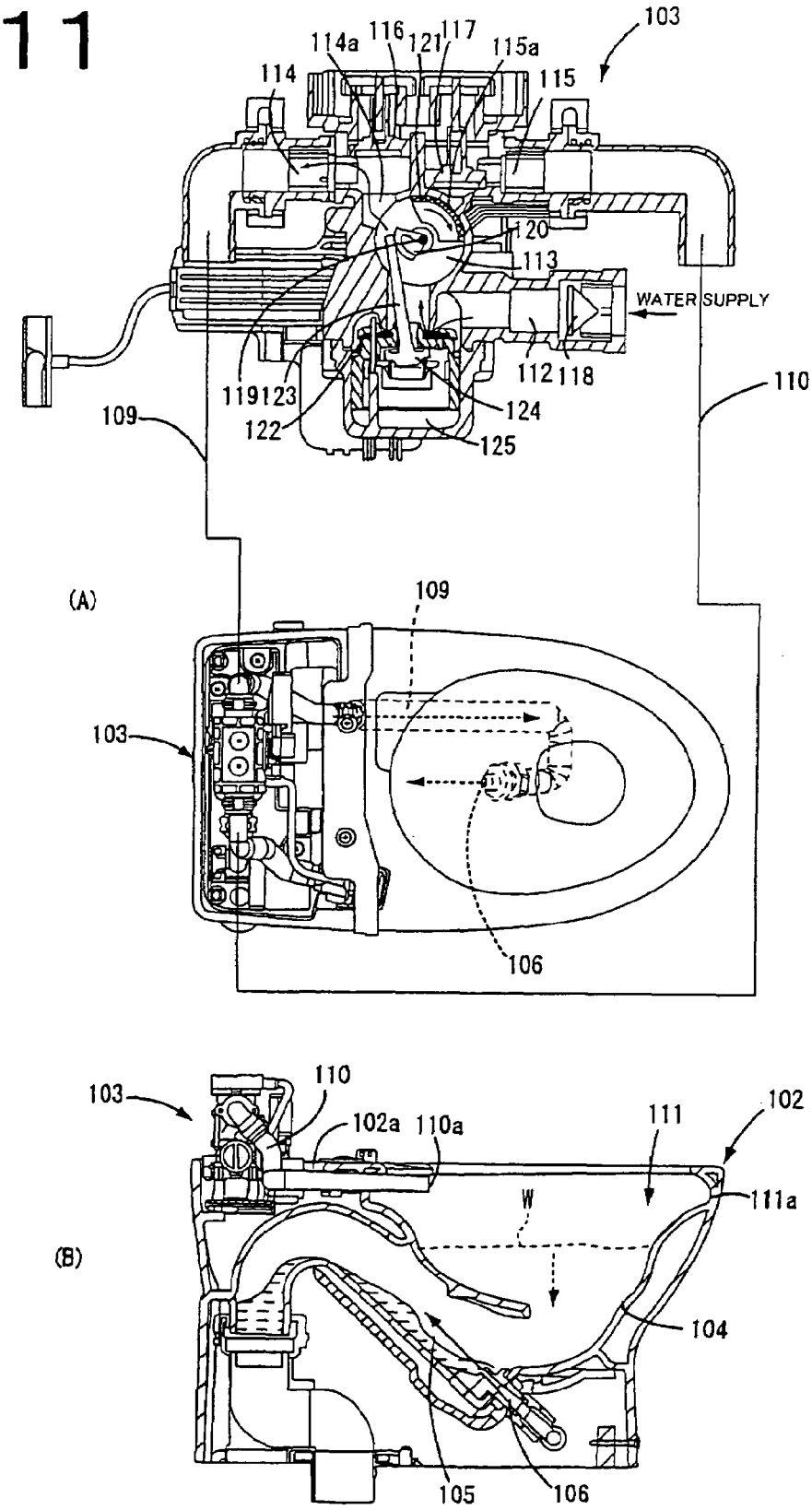
FIG. 11 is a schematic drawing of jet wash mode 1 in the toilet device related to the third embodiment of the present invention.

Next, FIG. 11 is used to explain "jet wash mode 1". In the state of "rim wash mode 1" of FIG. 10, when a "pour" command is sent from the control portion 128 of the toilet device 101 to the wash water supply device 103, the motor 127 is activated, the drive shaft 119 is further rotated, and the cam 120 is rotated along with the drive shaft 119 by a predetermined angle in a clockwise direction on the basis of flow rate distribution, which will be described hereinbelow. Since the cam 120 has the shape of a fan, the valve shaft 123 is held slanted, whereby the main valve 122 is held open. At this time, the switching valve 121 is in a position where it is fully opened on the pouring mouth 114*a* side, and is fully closed on the pouring mouth 115*a* side (position shown in the figure).

Therefore, the water is supplied in the proportion of a 20 L/min flow rate to the jet side, and almost zero flow rate to the rim side. The wash water set to a predetermined flow rate by the constant flow rate valve 118 flows out of the wash water distribution chamber 113 into the pouring mouth 114*a*, flows into the jet water supply path 109 while pushing up the negative pressure breaking valve 116, and is spewed out of the jet water supply portion 106 of the toilet 102 towards the trap portion 105, to perform jet wash. When the wash water is spewed out of the jet water supply portion 106 to the trap portion 105 continuously for a predetermined period of time, the siphon effect occurs on the trap portion 105, whereby the trapped water W inside the bowl portion 104 is discharged, thus the bowl portion 104 is empty of the trapped water W. If the inside of the bowl portion 104 is cleaned using a cleaning substance during "rim wash mode 1", the cleaning substance is discharged along with the trapped water W from the trap portion 105. However, the cleaning substance suspended on the upper face of the trapped water W is remained by flowing backward. For this reason, in order to prevent the trapped water W which contains the cleaning substance from going back from the trap portion 105 to the bowl portion 104 when the siphon effect is completed, the jet wash is performed for a constant period of time even after the siphon effect is completed, so as to completely discharge the trapped water.

Figure 12:
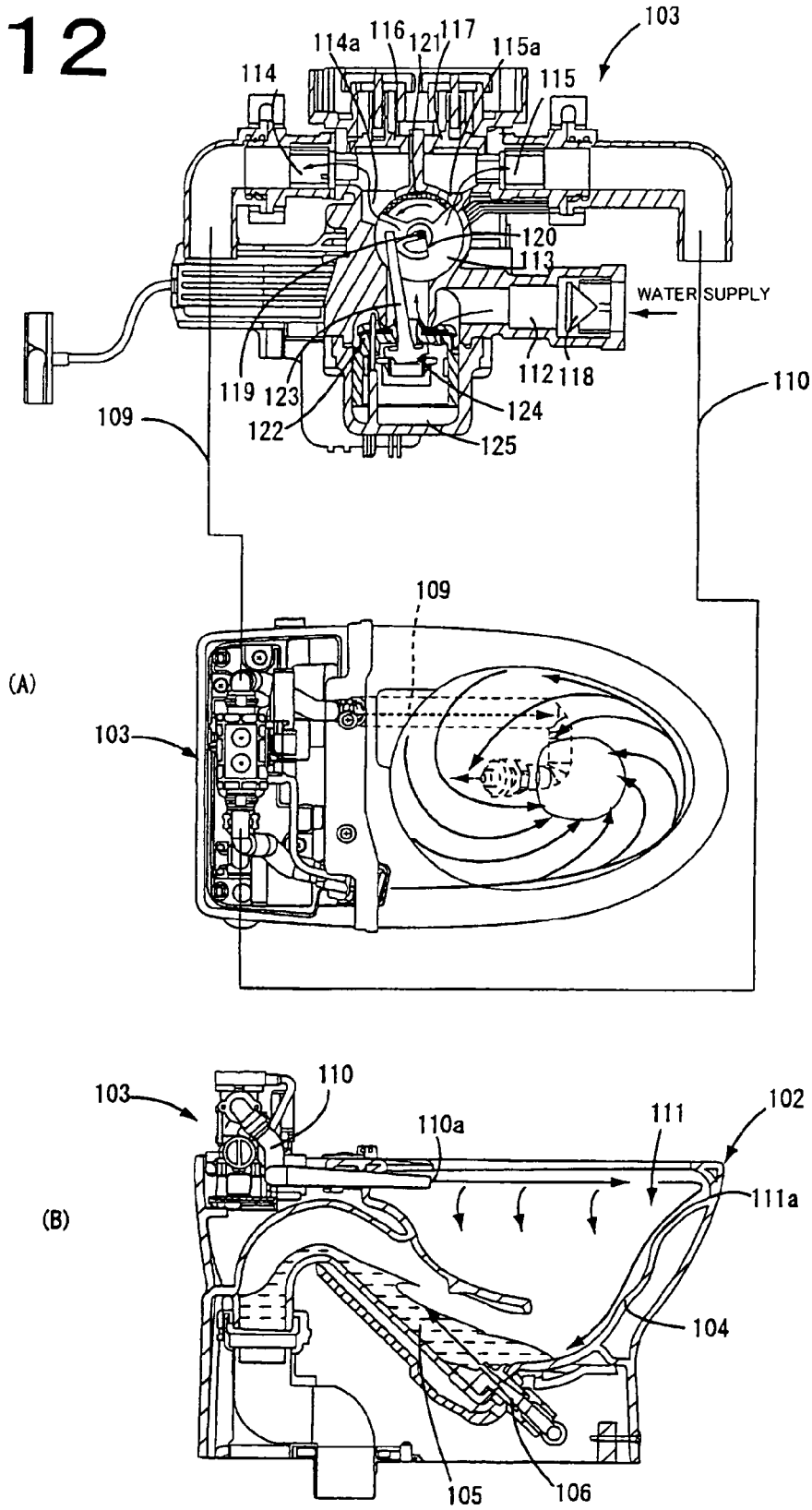
FIG. 12 is a schematic drawing of jet wash mode 2 in the toilet device related to the third embodiment of the present invention.

Next, FIG. 12 is used to explain "jet wash mode 2". In the state of "jet wash mode 1" of FIG. 11, when a "pour" command is sent from the control portion 128 of the toilet device 101 to the wash water supply device 103, the motor 127 is activated/operated, the drive shaft 119 is further rotated, and the cam 120 is rotated along with the drive shaft 119 by a predetermined angle in a clockwise direction on the basis of flow rate distribution, which will be described hereinbelow. Since the cam 120 the shape of a fan, the valve shaft 123 is held slanted, whereby the main valve 122 is held open. At this time, the switching valve 121 is in a position where it is half-open on the pouring mouth 114*a* side and is slightly opened on the pouring mouth 115*a* side (position shown in the figure).

Therefore, the water is supplied in the proportion of a 15 L/min flow rate to the jet side, and a 5 L/min flow rate to the rim side. Specifically, the switching valve 121 is rotated by a predetermined angle in a counterclockwise direction, slightly closes the pouring mouth 114*a* of the jet water supply port 114, and slightly opens the pouring mouth 115*a* of the rim water supply port 115, thus a large portion of the wash water set to a predetermined flow rate by the constant flow rate valve 118 flows out of the wash water distribution chamber 113 into the pouring mouth 114*a*, and is spewed out of the jet water supply portion 106 towards the trap portion 105. A portion of the rest [of the wash water] flows into the pouring mouth 115*a* and is spouted out of the rim water supply mouth 110*a* to the rim portion 111. The cleaning substance remained on the surface of the bowl portion 104 is washed away to the trap portion 105 by the wash water spouted out into the rim portion 111, whereby the cleaning substance is discharged to the outside of the toilet by the wash water which is spewed out of the jet water supply portion 106. In "jet wash mode 2", supply of water is continued from the jet water supply in "jet wash mode 1", and the water is supplied to the jet side at a flow rate of 15 L/min, thus the water supplied to the rim side [at a flow rate of] 5 L/min can be discharged without being trapped in the bowl portion 104, whereby the bowl portion 104 is empty of the trapped water W. Further, because the wash water spouted out to the rim portion 111 flows down to the trap portion 105, the surface of the jet water supply portion 106 which is empty of the trapped water W due to the siphon effect is filled with the wash water, thus the flushing sound of the wash water coming from the jet water supply portion 106 is lowered.

Moreover, since the wash water set to a predetermined flow rate by the constant flow rate valve 118 is distributed to the jet water supply portion 106 and rim water supply mouth 110*a*, the sum of the flow rate of the wash water spewed out of the jet water supply portion 106 and the flow rate of the wash water spouted out of the rim water supply mouth 110*a* is equal to the flow rate obtained when [the wash water] is supplied independently from the jet water supply portion 106 and rim water supply mouth 110*a* to the toilet 102. As a result, it is possible to save water when supplying the wash water from the jet water supply portion 106 and rim water supply mouth 110*a* simultaneously to the toilet 102, and also the total amount of water supply obtained as the product of the flow rate and the spouting time can be calculated readily.

Figure 13:
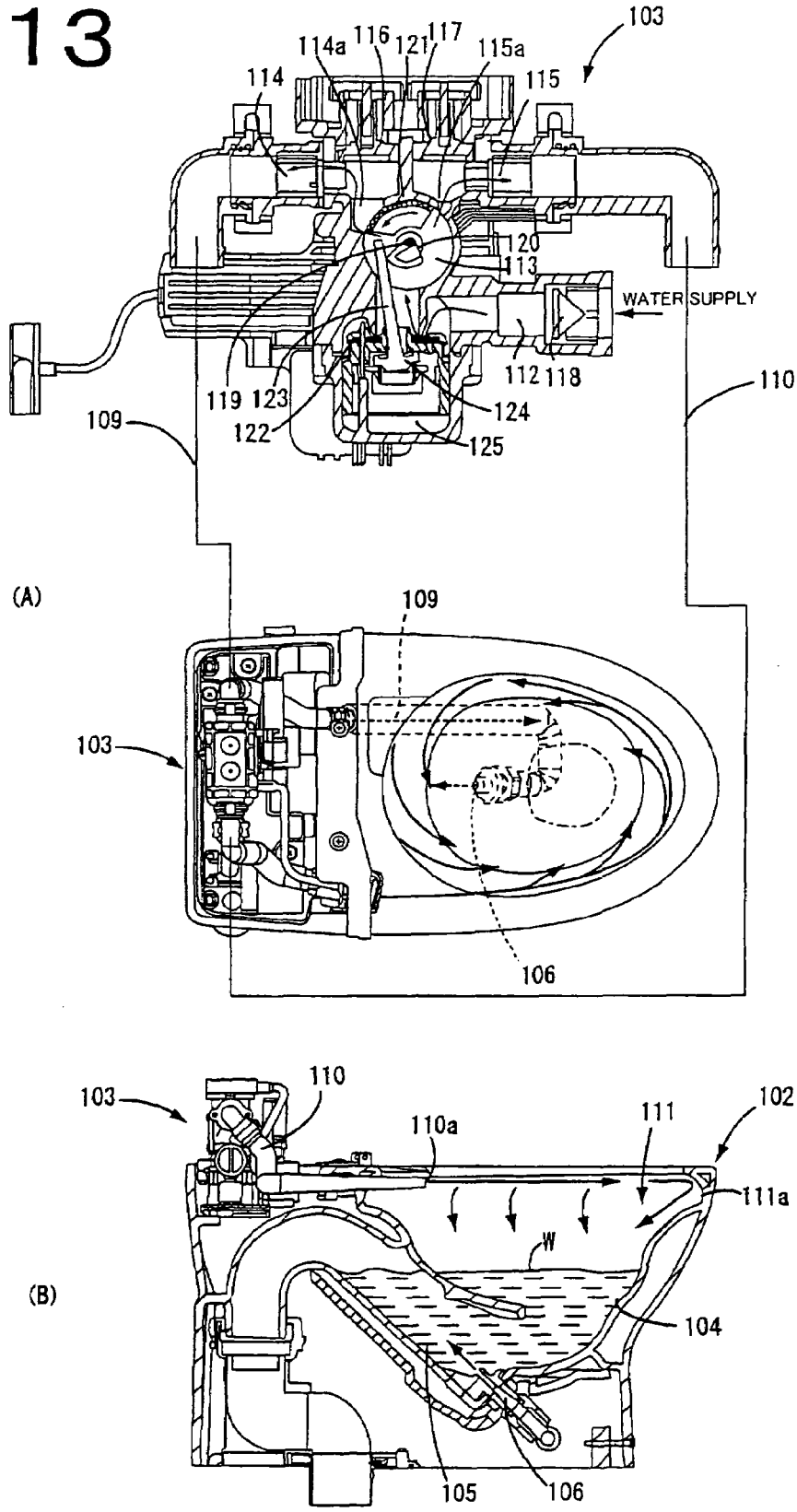
FIG. 13 is a schematic drawing of jet wash mode 2 in the toilet device related to the third embodiment of the present invention.

Next, FIG. 13 is used to explain "rim wash mode 2". In the state of "jet wash mode 2" of FIG. 12, when a "pour" command is sent from the control portion 128 of the toilet device 101 to the wash water supply device 103, the motor 127 is activated, the drive shaft 119 is further rotated, and the cam 120 is rotated along with the drive shaft 119 by a predetermined angle in a clockwise direction on the basis of flow rate distribution, which will be described hereinbelow. Since the cam 120 has the shape of a fan, the valve shaft 123 is held slanted, whereby the main valve 122 is held open. At this time, the switching valve 121 is in a state where it is slightly opened on the pouring mouth 114*a* side, and is in a position where it is fully opened on the pouring mouth 115*a* side (position shown in the figure).

Therefore, the water is supplied in the proportion of a 2 L/min flow rate to the jet side, and an 18 L/min flow rate to the rim side. Specifically, the switching valve 121 is rotated by a predetermined angle in a counterclockwise direction, slightly opens the pouring mouth 114*a* of the jet water supply port 114, fully opens the pouring mouth 115*a* of the rim water supply port 115, and then stops, thus a large portion of the wash water set to a predetermined flow rate by the constant flow rate valve 118 flows out of the wash water distribution chamber 113 into the pouring mouth 115*a* to go through the rim water supply path 110, and is spouted out of the rim water supply mouth 110*a* to the bowl portion 104, to perform post-rim wash for forming the trapped water W. At this time, the amount of the [wash] water supplied on the jet side is as low as 2 L/min, thus the water starts to build up again in the bowl portion 104. Further, since the flow rate of the wash water spouted out of the rim water supply mouth 110*a* is set to a predetermined flow rate by the constant flow rate valve 118, by controlling only the time when the water is spouted out of the rim water supply mouth 110*a*, the water level is raised to a predetermined level, whereby the trapped water W can be formed.

When having the idle state of FIG. 9, after supplying the wash water for a period of time required for forming the trapped water W, the drive shaft 119 is rotated in a counterclockwise direction, the cam 120 is pulled out of the valve shaft 123, thereby closing the main valve 122, and stops at a point of time where introducing the wash water is stopped.

Figure 14:
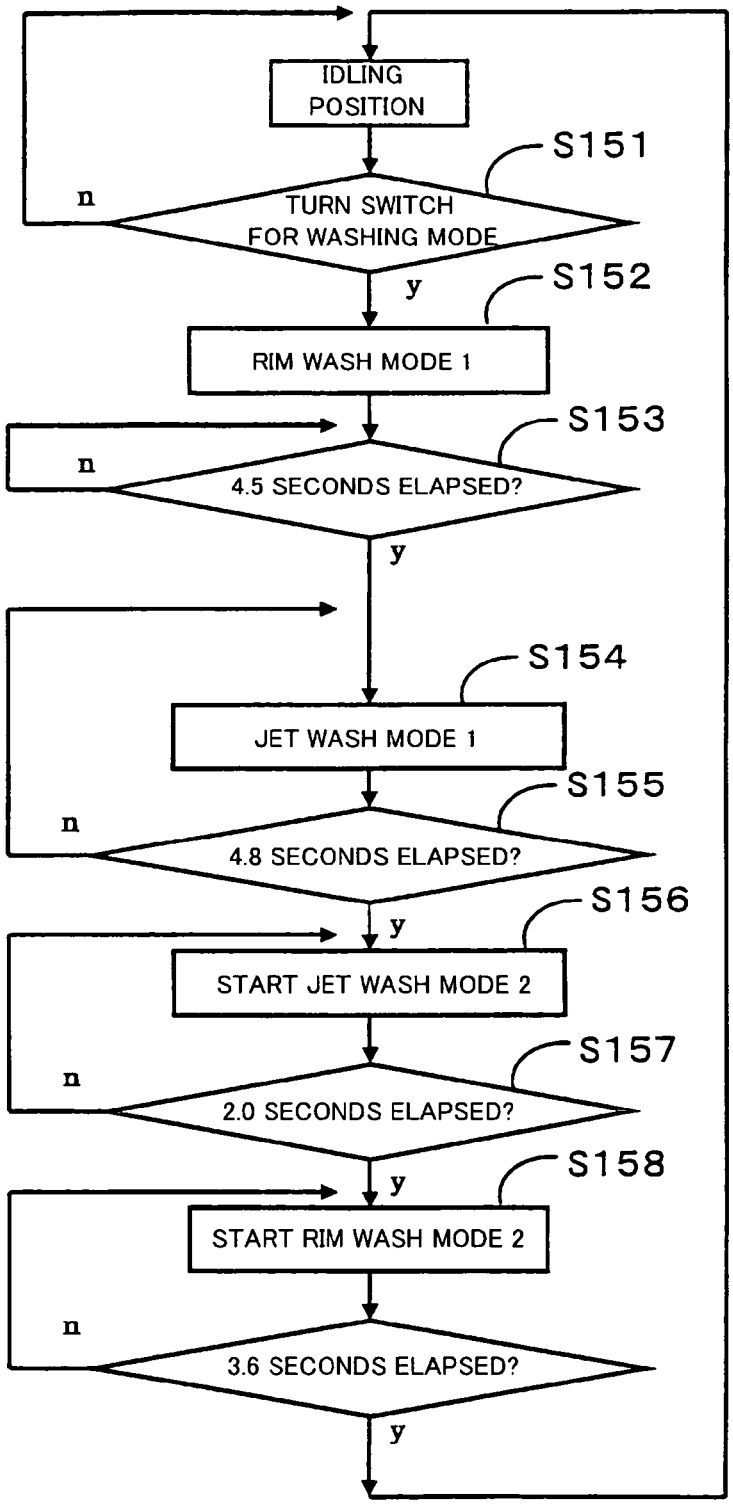
FIG. 14 is a flow chart of a program operation related to the third embodiment of the present invention (1)

Next, a flow chart of FIG. 14 is used to explain flushing of the toilet after use. As shown in FIG. 14, when pressing a switch for toilet flushing 129*b* installed in a remote control 129 shown in FIG. 16 (or when a user detection sensor detects the departure of a user) (step S151), the power of the motor 127 is turned on, the switching valve 121 and main valve 122 shown in FIG. 9 are moved to their positions for "rim wash mode 1" shown in FIG. 10, whereby the wash water is supplied into the bowl portion 111 and flushing of the bowl portion 111 is performed (step S152).

After a lapse of 4.5 seconds in the state of "rim wash mode 1" (step S153), [the abovementioned positions] are moved to the positions for "jet wash mode 1" shown in FIG. 11, the siphon effect is allowed to occur by supplying the wash water into the trap portion 105, whereby stains are discharged to the outside of the toilet 102 through the trap portion 105 (step S154). After a lapse of 4.8 seconds in the state of "jet wash mode 1" (step S155), [the above positions] are moved to the positions for "jet wash mode 2" shown in FIG. 12, the wash water is supplied into the bowl portion 111 and trap portion 105 simultaneously, and the stains floating and remained on the surface of the trapped water are pushed into the trap portion 105 and is then discharged to the outside of the toilet 102 through the trap portion 105 (step S156). After a lapse of two seconds in the state of "jet wash mode 2" (step S157), [the above positions] are moved to the positions for "rim wash mode 2" shown in FIG. 13 (step S158), and the trapped water W is formed in the bowl portion 111 of the toilet 102.

Figure 15:
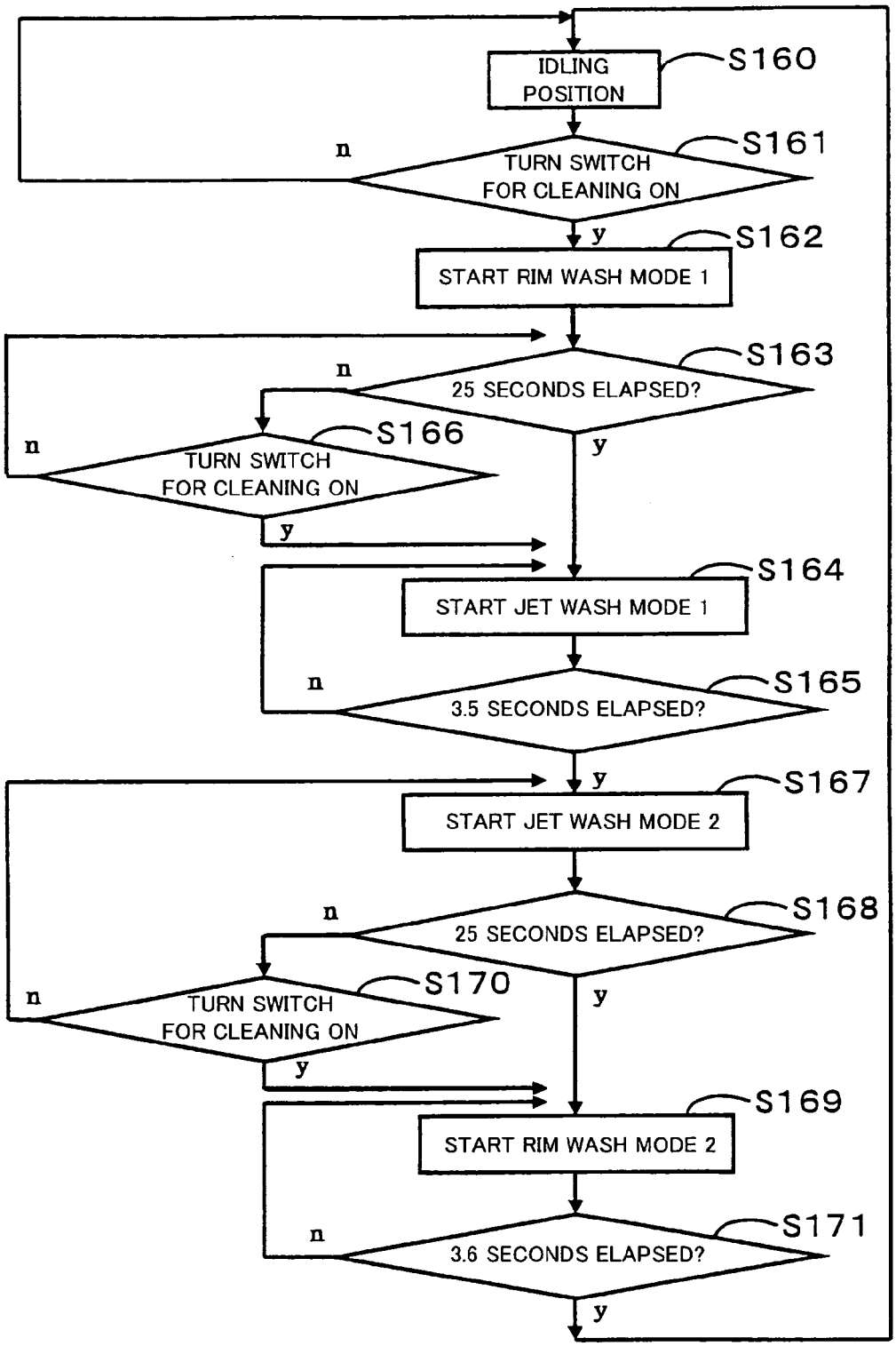
FIG. 15 is a flow chart of a program operation related to the third embodiment (2)

Next, a flow chart for a cleaning mode of FIG. 15 is used to explain the cleaning modes for cleaning the third embodiment toilet 102. The things that are different from the flow of the normal toilet flushing are that the time for each wash mode is changed, and that the wash mode is transferred to the next wash mode when the switch for cleaning is pressed during each wash mode.

Figure 16:
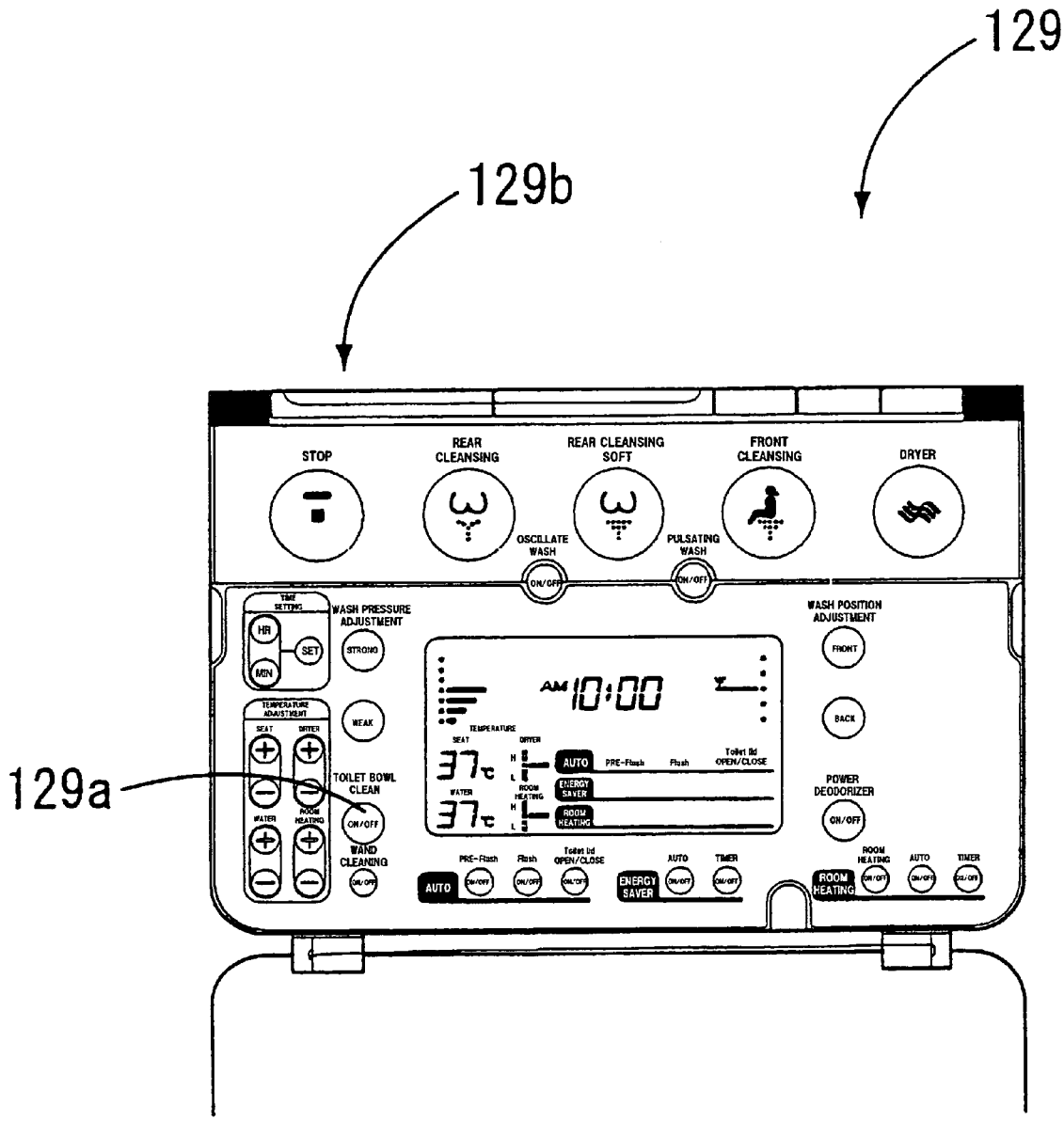
FIG. 16 is an external view of a remote control related to the third embodiment of the present invention.

Specifically, the switch for cleaning 129*a* installed in the remote control 129 in FIG. 16 is turned on (step S161), "rim wash mode 1" (rim: 13 L/min, jet: 7 L/min) described in FIG. 10 above is started (step S162). After operating this "rim wash mode 1" for 25 seconds straight (step S163), "jet wash mode 1" (jet: 20 L/min) described in FIG. 11 above is started (step S164). By operating this "jet wash mode 1" for 3.5 seconds straight, the trapped water W is discharged (step S165). Further, if turning on the switch for cleaning 29*a* again within 25 seconds during the "rim wash mode 1" (step S166), "jet wash mode 1" is started even before 25 seconds elapses (step S164). After a lapse of 3.5 seconds of the "jet wash mode 1", "jet wash mode 2" (rim: 5 L/min, jet: 15 L/min) described in FIG. 12 above is started (step S167). After operating this "jet wash mode 2" for 25 seconds straight (step S168), "rim wash mode 2" (rim: 18 L/min, jet: 5 L/min) described in FIG. 13 above is started, and the trapped water W is formed (step S169). Further, if turning on the switch for cleaning 29*a* again within 25 seconds during the "jet wash mode 2" (step S170), the "rim wash mode 2" is started even before 25 seconds elapses (step S169). After operating the "rim wash mode 2" for 3.6 seconds straight (step S171), [the valves] close by themselves and are brought to an idle state (step S160). Specifically, if the switch for cleaning 129*a* is pressed once in the idle state, "rim wash mode 1" is executed, and if the switch for cleaning 129*a* is pressed twice in the idle state, the trapped water is discharged in "jet wash mode 1", and thereafter "jet wash mode 2" is executed, thus, by means of operation of the switch for cleaning 129*a*, it is possible to select execution of the toilet wash mode in which the states where the trapped water is present or not vary.

In the past, when cleaning [a bowl portion] the trapped water W was discharged in order to wet the bowl face; however, by operating "rim wash mode 1" for 25 seconds, the bowl face can be wetted without discharging the trapped water W, thus no water is wasted. Further, by suspending "rim wash mode 1" without operating it for 25 seconds and by proceeding to the next mode "jet wash mode 2" to clean [the bowl face], economization of water can be achieved without wasting water.

In the past, if there is the trapped water W, when a user cleans [the bowl face] using a brush, a swash would happen and [the cleaning substance] would adhere to the user; however, by operating "rim wash mode 2" for 25 seconds, the trapped water W is kept discharged, thus the bowl portion can be cleaned thoroughly.

By executing the programs of "rim wash mode 1" and "jet wash mode 2", work and time for cleaning can be saved. Further, when operating the programs, if the switch for cleaning is turned on again during "rim wash mode 1", the transition is made to the next mode "jet wash mode 1" with prioritizing a switch command, and if turning on the switch for cleaning again during "jet wash mode 2", the transition is made to "rim wash mode 2" with prioritizing the switch command, thus the times for "rim wash mode 1" and "jet wash mode 2" can be changed with one switch (reduction of the switches), there is no need to wait for each mode to end so as to respond to a cleaning work for each household.

Next, an operation for suspending the cleaning mode in the middle will now be described as a reference example. If turning on a stop switch of the remote control 129 during the operation of "rim wash mode 1", the transition is made to a suspending operation of the cleaning mode. "Rim wash mode 1" is stopped immediately to make the transition to "jet wash mode 1", and contaminated trapped water is discharged by the siphon effect by cleaning. Thereafter, the transition is made to "rim wash mode 2" without executing "jet wash mode 2" to replenish the trapped water from the rim, and the cleaning mode is completed. This operation differs from the above-described embodiment in that only "rim wash mode 1" is executed as the toilet cleaning mode; however, it is possible to change the time for the toilet wash mode for cleaning with prioritizing the command sent by the switching operation, thus, by setting a time in accordance with the cleaning work at each household, economization of water can be achieved without wasting water.

In the present embodiment, although one switch for cleaning is operated, it goes without saying that switches for "rim wash mode 1" and "jet wash mode 2" may be prepared. In this case, when pressing the switch for "jet wash mode 2" in the idle state, a step of the first rim wash can be eliminated by performing water supply in the order of, for example, "jet wash mode 1", "jet wash mode 2", and "rim wash mode 1".

Further, as to the form of the rim portion of the toilet of the toilet device related to the third embodiment of the present invention, a slit-shaped (i.e. open-rim type) form where the lower face is continued may be applied instead of the rim portion 11 of the present embodiment as shown in FIG. 9.

Although preferred embodiments of the present invention have been explained as above, and these are examples for providing explanation of the present invention, thus it is not intended to limit the scope of the present invention to these embodiments alone. The present invention can be implemented in various other forms without departing from its subject-matter.

The invention claimed is:

1. A toilet device comprising:

water supply means for supplying water to a rim water supply portion which flushes wash water onto a bowl face of a toilet and to a jet water supply portion disposed at one side of a trap drainage portion of the toilet; and a control portion for controlling operation of the water supply means, wherein the toilet device is provided with a switch for flushing and a switch for cleaning, which is operated when a user cleans the toilet with a brush, said switch for flushing and said switch for cleaning being separate switches, when the switch for flushing is operated, water is supplied to the jet water supply portion to discharge the water on the surface of trapped water in the toilet, and said water supply means is activated by said control portion such that water flows into said trap drainage portion for a period of time shorter than the time for cleaning the toilet, and, when the switch for cleaning is operated, water is supplied to said jet water supply portion to discharge the water on the surface of trapped water in the toilet, and said water supply means is activated by said control portion such that water flows into said trap drainage portion for a period of time longer than the time for flushing the toilet after use, to keep the trapped water of the inside of said bowl face discharged.

2. The toilet device according to claim 1, wherein said control portion supplies water to said rim water supply portion for a predetermined period of time, prior to supplying water to said jet water supply portion.

3. The toilet device according to claim 2, wherein said control portion supplies water to said rim water supply portion for a predetermined period of time after supplying water to said jet water supply portion for a predetermined period of time.

4. The toilet device according to claim 2, wherein, when said switch for cleaning is operated before a predetermined period of time elapses, said control portion deems that the predetermined period of time has elapsed and proceeds to a next step.

5. The toilet device according to claim 1, wherein, after said water supply is stopped, said control portion first supplies water to the rim water supply portion for a certain period of time, then performs jet wash, and finally supplies the water to the rim water supply portion again.

6. The toilet device according to claim 3, wherein, when said switch for cleaning is operated before a predetermined period of time elapses, said control portion deems that the predetermined period of time has elapsed and proceeds to a next step.

* * * * *